US009279094B2

(12) United States Patent
Styer et al.

(10) Patent No.: US 9,279,094 B2
(45) **Date of Patent: *Mar. 8, 2016**

(54) FRICTION MODIFIERS FOR USE IN LUBRICATING OIL COMPOSITIONS

(71) Applicant: Afton Chemical Corporation, Richmond, VA (US)

(72) Inventors: Jeremy P. Styer, Richmond, VA (US); John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 30 days.

This patent is subject to a terminal disclaimer.

(21) Appl. No.: 13/725,216

(22) Filed: Dec. 21, 2012

(65) Prior Publication Data

US 2014/0179579 A1 Jun. 26, 2014

(51) Int. Cl.

| | |
|---|---|
| ***C07F 5/04*** | (2006.01) |
| ***B01D 19/04*** | (2006.01) |
| ***C10M 133/06*** | (2006.01) |
| ***C08K 5/29*** | (2006.01) |
| ***C10M 115/08*** | (2006.01) |
| ***C10M 133/16*** | (2006.01) |
| ***C10M 163/00*** | (2006.01) |

(52) U.S. Cl.

CPC ..... *C10M 133/16* (2013.01); *C10M 163/00* (2013.01); *C10M 2215/08* (2013.01); *C10M 2215/082* (2013.01); *C10N 2210/01* (2013.01); *C10N 2230/06* (2013.01); *C10N 2230/52* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01); *C10N 2240/106* (2013.01)

(58) Field of Classification Search

CPC ..... C10M 2227/061; C10M 2215/04; C10M 2215/28

See application file for complete search history.

(56) References Cited

U.S. PATENT DOCUMENTS

| | | | |
|---|---|---|---|
| 2,841,555 | A | 7/1958 | Lyons et al. |
| 2,905,644 | A | 9/1959 | Butter |
| 3,156,652 | A | 11/1964 | Foehr |
| 3,156,653 | A | 11/1964 | Foehr |
| 3,324,155 | A | 6/1967 | Thompson et al. |
| 3,640,872 | A | 2/1972 | Wiley et al. |
| 3,652,410 | A | 3/1972 | Hollinghurst et al. |
| 3,879,306 | A | 4/1975 | Kablaoui et al. |
| 3,933,659 | A | 1/1976 | Lyle et al. |
| 4,035,309 | A | 7/1977 | Brois |
| 4,097,389 | A | 6/1978 | Andress, Jr. |
| 4,162,224 | A | 7/1979 | Bridger |
| 4,374,032 | A | 2/1983 | Gemmill et al. |
| 4,375,418 | A | 3/1983 | Zoleski et al. |

(Continued)

FOREIGN PATENT DOCUMENTS

| | | | |
|---|---|---|---|
| CN | 1274743 | A | 11/2000 |
| CN | 102329681 | A2 * | 1/2012 |

(Continued)

OTHER PUBLICATIONS

Final Office Action; Mailed Oct. 14, 2014 for related U.S. Appl. No. 13/725,319.

(Continued)

*Primary Examiner* — Vishal Vasisth

(74) *Attorney, Agent, or Firm* — Mendelsohn Dunleavy, PC

(57) ABSTRACT

A lubricating oil comprising a major amount of base oil and a minor amount of an additive package comprising a friction modifier component selected from:

(A) one or more friction modifiers of the formulae I and II:

(I)

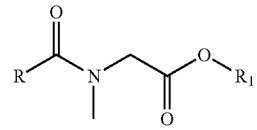

(II)

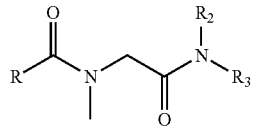

(B) two or more friction modifiers independently selected from the formulae III and IV:

(III)

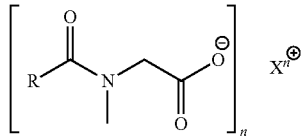

(IV)

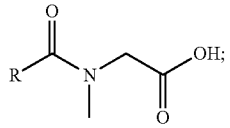

and (C) at least one friction modifier of the formulae III and IV in combination with at least one friction modifier of the formulae I and II, and R, $R_1$, $R_2$, $R_3$, X and n are as defined in the specification.

35 Claims, No Drawings

(56) References Cited

U.S. PATENT DOCUMENTS

| | | | | |
|---|---|---|---|---|
| 4,536,307 | A | 8/1985 | Horodysky | |
| 4,618,436 | A | 10/1986 | Horodysky | |
| 5,062,890 | A | 11/1991 | Miyashita et al. | |
| 5,131,921 | A | 7/1992 | Sung et al. | |
| 5,334,329 | A | 8/1994 | Vinci | |
| 5,569,407 | A * | 10/1996 | Avery | C10L 1/143 508/454 |
| 5,599,779 | A | 2/1997 | Karol et al. | |
| 5,700,766 | A | 12/1997 | Hellsten et al. | |
| 6,410,490 | B1 | 6/2002 | Reyes-Gavilan et al. | |
| 6,451,745 | B1 | 9/2002 | Ward | |
| 7,977,287 | B1 | 7/2011 | Hicks et al. | |
| 8,084,403 | B2 | 12/2011 | Lam et al. | |
| 8,148,306 | B2 | 4/2012 | Bartley et al. | |
| 8,303,850 | B2 | 11/2012 | Shibata et al. | |
| 2005/0059562 | A1 | 3/2005 | Garmier | |
| 2006/0217275 | A1* | 9/2006 | Imai et al. | 508/321 |
| 2007/0155631 | A1 | 7/2007 | Muir | |
| 2009/0082232 | A1* | 3/2009 | Ikeda et al. | 508/108 |
| 2010/0009878 | A1 | 1/2010 | Baba et al. | |
| 2011/0030269 | A1 | 2/2011 | Chasan et al. | |
| 2011/0118157 | A1* | 5/2011 | Cook et al. | 508/243 |

FOREIGN PATENT DOCUMENTS

| | | | | |
|---|---|---|---|---|
| CN | 102498194 | A | 6/2012 | |
| DE | 122102 | A1 | 9/1976 | |
| EP | 0714974 | A1 | 6/1996 | |
| EP | 0798367 | A2 | 10/1997 | |
| EP | 1354933 | A1 | 10/2003 | |
| EP | 1661968 | A1 | 5/2006 | |
| EP | 1054052 | B1 | 6/2006 | |
| EP | 1734103 | A1 | 12/2006 | |
| EP | 1881057 | A1 | 1/2008 | |
| EP | 2371935 | A1 | 10/2011 | |
| EP | 2610330 | A1 | 7/2013 | |
| FR | 1440207 | A | 5/1966 | |
| GB | 951139 | A | 3/1964 | |
| GB | 1099736 | | 1/1968 | |
| GB | 1099736 | A | 1/1968 | |
| GB | 1235896 | | 6/1971 | |
| JP | H0665589 | A | 3/1994 | |
| JP | 2002012884 | A | 1/2002 | |
| JP | 2010260977 | A | 11/2010 | |
| JP | 2012102280 | A | 5/2012 | |
| WO | WO9936491 | A2 | 7/1999 | |
| WO | WO0071649 | A1 | 11/2000 | |
| WO | WO2009140108 | A1 | 11/2009 | |
| WO | WO2010033447 | A2 | 3/2010 | |
| WO | WO 2010092010 | A1 * | 8/2010 | |
| WO | WO 2011017555 | A1 * | 2/2011 | C10M 133/12 |
| WO | WO2012047949 | A1 | 4/2012 | |

OTHER PUBLICATIONS

Final Office Action; Mailed Oct. 8, 2014 for related U.S. Appl. No. 13/725,290.
Final Office Action; Mailed Oct. 8, 2014 or related U.S. Appl. No. 13/725,446.
Final Office Action; Mailed Oct. 14, 2014 for related U.S. Appl. No. 13/725,411.
Restriction Requirement; Mailed Oct. 2, 2014 for related U.S. Appl. No. 13/725,482.
Non-Final Office Action; Mailed Dec. 2, 2014 for related U.S. Appl. No. 13/725,482.
Advisory Action; Mailed Dec. 22, 2014 for the relation U.S. Appl. No. 13/725,411.
Advisory Action; Mailed Dec. 16, 2014 for the relation U.S. Appl. No. 13/725,446.
Advisory Action; Mailed Dec. 22, 2014 for the relation U.S. Appl. No. 13/725,319.
Advisory Action; Mailed Dec. 17, 2014 for the relation U.S. Appl. No. 13/725,290.
Non-Final Office Action; Mailed Mar. 6, 2015 for U.S. Appl. No. 13/725,411.
Non-Final Office Action; Mailed Mar. 6, 2015 for U.S. Appl. No. 13/725,446.
Non-Final Office Action; Mailed Mar. 6, 2015 for U.S. Appl. No. 13/725,319.
Chinese Office Action; Mailed Mar. 30, 2015 for CN Application No. CN201310716432.8.
Chinese Office Action; Mailed Mar. 30, 2015 for CN Application No. CN201310714844.8.
Chinese Office Action; Mailed Mar. 2, 2015 for CN Application No. CN201310716602.2.
Non-Final Office Action, Mailed Mar. 12, 2015 for U.S. Appl. No. 13/725,290.
Japanese Office Action; Mailed May 27, 2015 for JP Application No. 2013-260204.
Japanese Office Action; Mailed May 27, 2015 for JP Application No. 2013-260205.
Japanese Office Action; Mailed May 27, 2015 for JP Application No. 2013-260208.
Notice of Allowance and Fee(s) due; Mailed Jul. 28, 2015 for U.S. Appl. No. 13/725,482.
European Search Report; Mailed Aug. 13, 2014 for related EP Application No. EP 13199016.0.
Non-Final Office Action; Mailed May 15, 2014 for related U.S. Appl. No. 13/725,411.
European Search Report; Mailed Jul. 18, 2014 for related EP Application No. EP 13199033.5.
Non-Final Office Action; Mailed May 19, 2014 for related U.S. Appl. No. 13/725,446.
European Search Report; Mailed Apr. 16, 2014 for related EP Application No. EP 13199044.
Non-Final Office Action; Mailed May 19, 2014 or related U.S. Appl. No. 13/725,290.
European Search Report; Mailed May 2, 2014 for related EP Application No. EP 13199054.1.
European Search Report; Mailed Aug. 13, 2014 for related EP Application No. EP 13198977.4.
Non-Final Office Action; Mailed May 21, 2014 for related U.S. Appl. No. 13/725,319.
"The Advent of Modern Hydroprocessing—The Evolution of Base Oil Technology—Part 2," Machinery Lubrication, May 2003, pp. 1-6 from Chevron Global Lubricants.
European Search Report; Mailed Apr. 16, 2014 for related EP Application No. EP 13199141.6.

* cited by examiner

FRICTION MODIFIERS FOR USE IN LUBRICATING OIL COMPOSITIONS

BACKGROUND

1. Field

The present disclosure is directed to lubricating oil compositions, such as engine oils, containing acyl N-methyl glycine derivatives. For example, it is directed to lubricating oil compositions containing acyl N-methyl glycine derivatives as friction modifiers for reducing one or both of thin film friction and boundary layer friction.

2. Description of the Related Technology

Lubricating oil compositions play an important role in ensuring smooth operation of machinery, like engines. These compositions may lubricate a variety of sliding parts in an engine including, for example, piston rings/cylinder liners, bearings of crankshafts and connecting rods, valve mechanisms including cams and valve lifters, and the like. Lubricating oil compositions may also play a role in cooling the inside of an engine and dispersing combustion products. Further possible functions of lubricating oil compositions may include preventing or reducing rust and corrosion.

There are several classes of lubricating compositions including engine oils, gear oils, tractor oils, multifunctional oils, and the like. Each type of lubricating composition may require customized properties for the particular application in which it is to be used.

The principle consideration for engine oils is to prevent wear and seizure of parts in the engine. Lubricated engine parts operate mostly in a state of hydrodynamic or full fluid lubrication, but valve systems and top and bottom dead centers of pistons/cylinder liner contact zones are likely to be in a state of thin-film (elastohydrodynamic) and/or boundary lubrication. The friction between these parts in the engine may result in significant energy losses and thereby reduce fuel efficiency. Many types of friction modifiers have been used in engine oils to decrease frictional energy losses.

Improved efficiency may be achieved when friction between moving parts is reduced. Thin-film friction is the friction generated by a fluid, such as a lubricant, moving between two surfaces, when the distance between the two surfaces is very small. It is known that some additives form films of different thicknesses, which can have an effect on thin-film friction. Some additives normally present in engine oils, such as zinc dialkyl dithiophosphate (ZDDP) are known to increase thin-film friction. Though such additives may be required for other reasons such as to protect engine parts, the increase in thin-film friction caused by such additives can reduce operating efficiency.

Reducing boundary layer friction in engines may also enhance fuel efficiency. The motion of contacting surfaces in an engine may be retarded by boundary layer friction. Non-nitrogen-containing, nitrogen-containing, and molybdenum-containing friction modifiers are sometimes used to reduce boundary layer friction.

In recent years there has been a growing desire to employ lower friction lubricating oils to provide higher energy efficiency, such as providing lower friction engine oils to improve fuel efficiency. The present disclosure provides an improved lubricating oil composition that may reduce one or both of thin film friction and boundary layer friction. The present disclosure is directed to lubricating oil compositions containing acyl N-methyl glycine derivatives as friction modifiers for reducing one or both of thin film friction and boundary layer friction.

U.S. Pat. No. 5,599,779 discloses a rust inhibitor composition consisting of a three component rust inhibitor package including a compound of the formula:

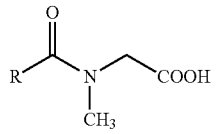

wherein R represents a $C_{8-18}$-alkyl or alkenyl group;

a dicarboxylic acid of the formula:

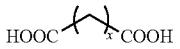

wherein x is an integer from 4 to 46; and an amine of the formula:

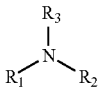

wherein $R^1$, $R^2$, and $R^3$ are independently selected from hydrogen, hydrocarbyl having up to 14 carbon atoms, hydroxyalkyl, cycloalkyl or polyalkyleneoxy groups. The rust inhibitor package is described as advantageous for use in a grease, and may be formulated with oils and waxes into rust preventative compositions for use in automotive and other industries.

WO 2009/140108 discloses the use of variety of different rust inhibiting compounds for certain types of multifunctional oils. In the specification there is a brief mention of the possibility of using a compound of the formula:

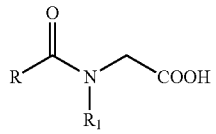

wherein R and $R_1$ are not defined. No further details are given as to the amounts that should be used, nor are any specific formulations including such compounds exemplified in the application.

GB 1235896 discloses multifunctional lubricants and includes an example of a wet brake formulation including oleoyl sarcosine. The exemplified composition also includes basic calcium sulphonate detergent (TBN=300), $P_2S_5$—polybutene barium phenate/sulphonate detergent, a dispersant that is a reaction product of polybutenyl succinic anhydride with an Mw=900 PIB group and tetraethylene pentamine, zinc dihexyl dithiophosphate, dioleoyl phosphite, sperm oil, and sulphurised polybutene.

SUMMARY

In one aspect, the present disclosure provides a lubricating oil composition comprising a major amount of base oil and a minor amount of an additive package, wherein the additive package comprises one or more friction modifier components selected from:

(A) one or more compounds of the formulae I and II:

(I)

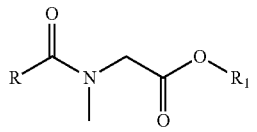

wherein R is a linear or branched, saturated, unsaturated, or partially saturated hydrocarbyl group having about 8 to about 22 carbon atoms and $R_1$ is a hydrocarbyl group having from about 1 to about 8 carbon atoms or a $C_1$-$C_8$ hydrocarbyl group containing one or more heteroatoms;

(II)

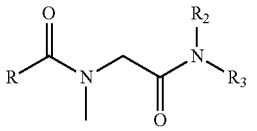

wherein R is a linear or branched, saturated, unsaturated, or partially saturated hydrocarbyl group having about 8 to about 22 carbon atoms and $R_2$ and $R_3$ are independently selected from hydrogen, $C_1$-$C_{18}$ hydrocarbyl groups, and $C_1$-$C_{18}$ hydrocarbyl groups containing one or more heteroatoms;

(B) at least two compounds independently selected from the formulae III and IV:

(III)

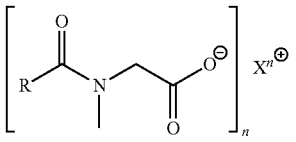

wherein R is a linear or branched, saturated, unsaturated, or partially saturated hydrocarbyl group having about 8 to about 22 carbon atoms; and X is an alkali metal, alkaline earth metal, or ammonium cation and n is the valence of cation X;

(IV)

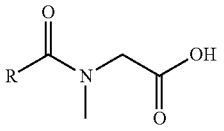

wherein R is a linear or branched, saturated, unsaturated, or partially saturated hydrocarbyl group having about 8 to about 22 carbon atoms; and (C) at least one compound of the formulae III and IV in combination with at least one compound of the formulae I and II.

The one or more friction modifiers of the formula I may be esters.

The one or more friction modifiers of the formula II may be amides.

The friction modifier may comprise at least one salt of the formula III.

The additive package may comprise at least two different friction modifiers independently selected from the formulae I-IV.

R may have from about 10 to about 20 carbon atoms. R may alternatively have from about 12 to about 18 carbon atoms.

$R_1$ may be a hydrocarbyl group having from about 1 to about 8 carbon atoms. Alternatively $R_1$ may be a hydrocarbyl group containing a $C_1$-$C_8$ hydrocarbyl group containing one or more heteroatoms.

$R_2$ and $R_3$ may be independently selected from hydrogen, $C_1$-$C_{18}$ hydrocarbyl groups, and $C_1$-$C_{18}$ hydrocarbyl groups containing one or more heteroatoms. Alternatively, $R_2$ and $R_3$ are independently selected from hydrogen and $C_4$-$C_8$ hydrocarbyl groups.

The one or more friction modifiers of the formula III may be salts of one or more cations selected from sodium, lithium, potassium, calcium, magnesium, and ammonium cations.

The foregoing lubricating oil composition may comprise an engine oil.

In another aspect, the present disclosure provides a lubricating oil composition comprising a major amount of a base oil and a minor amount of an additive package, wherein the additive package comprises one or more reaction products of:

one or more compounds of the Formula IV:

(IV)

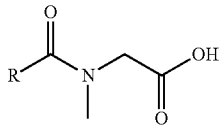

wherein R is a linear or branched, saturated, unsaturated, or partially saturated hydrocarbyl group having about 8 to about 22 carbon atoms, and the hydroxyl moiety on the acid group may be replaced by a suitable leaving group, if desired, prior to the reaction and one or more amines of the Formula V:

(V)

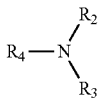

wherein $R_2$, $R_3$, and $R_4$ are independently selected from hydrogen, $C_1$-$C_{18}$ hydrocarbyl groups, and $C_1$-$C_{18}$ hydrocarbyl groups containing one or more heteroatoms.

R may have from about 10 to about 20 carbon atoms. $R_2$, $R_3$, and $R_4$ may be independently selected from hydrogen, $C_3$-$C_{12}$ hydrocarbyl groups, and hydrocarbons containing $C_3$-$C_{12}$ hydrocarbyl groups and one or more heteroatoms.

The foregoing lubricating oil composition may comprise an engine oil.

In yet another aspect, the present disclosure provides a lubricating oil composition comprising a major amount of a base oil and a minor amount of an additive package, wherein the additive package comprises one or more a reaction products of one or more alcohols with one or more compounds of the Formula IV:

(IV)

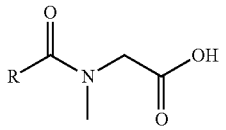

wherein R is a linear or branched, saturated, unsaturated, or partially saturated hydrocarbyl group having about 8 to about 22 carbon atoms. The hydroxyl moiety may be replaced by a suitable leaving group, if desired, prior to reaction with the alcohol. The alcohol may be represented by $R_1$—OH, where $R_1$ comprises a hydrocarbyl group or a $C_1$-$C_8$ hydrocarbyl group containing one or more heteroatoms.

R may be a hydrocarbyl group having from about 10 to about 20 carbon atoms.

The alcohol may contain a hydrocarbyl group having from about 1 to about 8 carbon atoms. Alternatively, the alcohol contains a hydrocarbyl group having from about 1 to about 8 carbon atoms and one or more heteroatoms.

The foregoing lubricating oil composition may comprise an engine oil.

The present disclosure also provides an engine oil composition comprising a major amount of a base oil and a minor amount of an additive package, wherein the additive package comprises one or more salts that are reaction products of:

one or more compounds of the formula IV:

(IV)

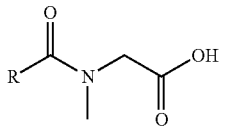

wherein R is a linear or branched, saturated, unsaturated, or partially saturated hydrocarbyl group having about 8 to about 22 carbon atoms; and an alkali or alkaline earth metal hydroxide, an alkali or alkaline earth metal oxide, ammonia, an amine or mixtures thereof.

The present disclosure also provides a lubricating oil comprising a major amount of a base oil and a minor amount of an additive package, wherein the additive package comprises one or more reaction products of:

one or more compounds of the formula IV:

(IV)

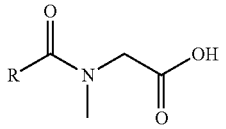

wherein R is a linear or branched, saturated, unsaturated, or partially saturated hydrocarbyl group having about 8 to about 22 carbon atoms, and one or more amine alcohol(s).

The amine alcohols may be selected from ethanolamine, diethanolamine, aminoethyl ethanolamine, tris-hydroxymethyl amino-methane (THAM), and mixtures thereof.

The present disclosure also provides a lubricating oil composition comprising a major amount of a base oil and a minor amount of an additive package, wherein the additive package comprises (A) a salt reaction product of one or more compounds of the formula IV:

(IV)

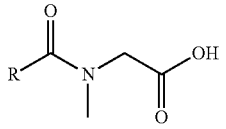

wherein R is a linear or branched, saturated, unsaturated, or partially saturated hydrocarbyl group having about 8 to about 22 carbon atoms, and one or more of an alkali metal hydroxide, and alkaline earth metal hydroxide, an alkali metal oxide, an alkaline earth metal hydroxide, ammonia, or an amine; and (B) at least one compound of the formulae I-IV different from the one or more compounds of component (A):

(I)

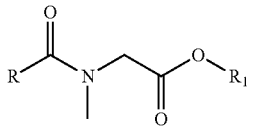

wherein R is a linear or branched, saturated, unsaturated, or partially saturated hydrocarbyl group having about 8 to about 22 carbon atoms and $R_1$ is a hydrocarbyl having from about 1 to about 8 carbon atoms or a $C_1$-$C_8$ hydrocarbyl group containing one or more heteroatoms;

(II)

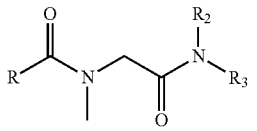

wherein R is a linear or branched, saturated, unsaturated, or partially saturated hydrocarbyl group having about 8 to about 22 carbon atoms and $R_2$ and $R_3$ are independently selected from hydrogen, $C_1$-$C_{18}$ hydrocarbyl groups, and $C_1$-$C_{18}$ hydrocarbyl groups containing one or more heteroatoms;

(III)

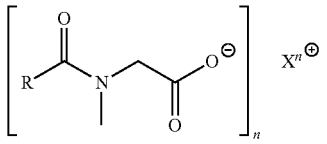

wherein R is a linear or branched, saturated, unsaturated, or partially saturated hydrocarbyl group having about 8 to about 22 carbon atoms; and X is an alkali metal, alkaline earth metal or ammonium cation and n is the valence of cation X; and (IV)

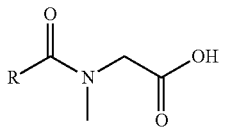

wherein R is a linear or branched, saturated, unsaturated, or partially saturated hydrocarbyl group having about 8 to about 22 carbon atoms.

In yet another aspect, the present disclosure provides a lubricating oil composition comprising a major amount of a base oil and a minor amount of an additive package, wherein the additive package comprises:

(A) one or more compounds of the formula IV:

(IV)

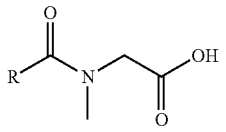

wherein R is a linear or branched, saturated, unsaturated, or partially saturated hydrocarbyl group having about 8 to about 22 carbon atoms; and (B) at least one compound of the formulae I-IV different from the one or more compounds of component (A):

(I)

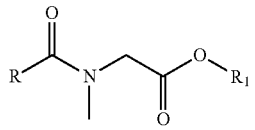

wherein R is a linear or branched, saturated, unsaturated, or partially saturated hydrocarbyl group having about 8 to about 22 carbon atoms and $R_1$ is a hydrocarbyl having from about 1 to about 8 carbon atoms or a $C_1$-$C_8$ hydrocarbyl group containing one or more heteroatoms;

(II)

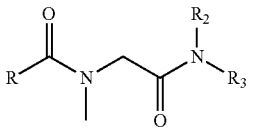

wherein R is a linear or branched, saturated, unsaturated, or partially saturated hydrocarbyl group having about 8 to about 22 carbon atoms and $R_2$ and $R_3$ are independently selected from hydrogen, $C_1$-$C_{18}$ hydrocarbyl groups, and $C_1$-$C_{18}$ hydrocarbyl groups containing one or more heteroatoms;

(III)

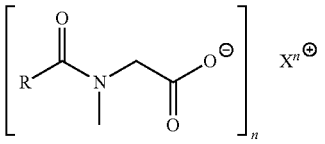

wherein R is a linear or branched, saturated, unsaturated, or partially saturated hydrocarbyl group having about 8 to about 22 carbon atoms; and X is an alkali metal, alkaline earth metal or ammonium cation and n is the valence of cation X; and (IV)

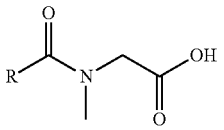

wherein R is a linear or branched, saturated, unsaturated, or partially saturated hydrocarbyl group having about 8 to about 22 carbon atoms.

The additive package may additionally comprise at least one additive selected from the group consisting of antioxidants, antifoam agents, molybdenum-containing compounds, titanium-containing compounds, phosphorus-containing compounds, viscosity index improvers, pour point depressants, and diluent oils.

The present disclosure provides a method for improving thin film and boundary layer friction between surfaces in contact moving relative to one another, comprising the step of lubricating the surface with a lubricating oil composition as disclosed herein. In some embodiments, the surfaces are the contacting surfaces of an engine.

The improved thin film and boundary layer friction may be determined relative to a same composition in the absence of the one or more friction modifiers as described herein.

In yet another aspect, the present disclosure provides a method for improving boundary layer friction between surfaces in contact moving relative to one another, comprising the step of lubricating the surface with a lubricating oil composition as disclosed herein. In some embodiments, the surfaces are the contacting surfaces of an engine.

The improved boundary layer friction may be determined relative to a same composition in the absence of the one or more friction modifiers as claimed in claim 1.

The present disclosure provides a method for improving thin film friction between surfaces in contact moving relative to one another, comprising the step of lubricating the surface with a lubricating oil composition as disclosed herein. In some embodiments, the surfaces are the contacting surfaces of an engine.

DEFINITIONS

The following definitions of terms are provided in order to clarify the meanings of certain terms as used herein.

It must be noted that as used herein and in the appended claims, the singular forms "a," "an," and "the" include plural references unless the context clearly dictates otherwise. Furthermore, the terms "a" (or "an"), "one or more," and "at least one" can be used interchangeably herein. The terms "comprising," "including," "having," and "constructed from" can also be used interchangeably.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent, or parameter disclosed herein is to be interpreted as being disclosed for use alone or in combination with one or more of each and every other component, compound, substituent, or parameter disclosed herein.

It is also to be understood that each amount/value or range of amounts/values for each component, compound, substituent, or parameter disclosed herein is to be interpreted as also being disclosed in combination with each amount/value or range of amounts/values disclosed for any other component(s), compounds(s), substituent(s), or parameter(s) disclosed herein and that any combination of amounts/values or ranges of amounts/values for two or more component(s), compounds(s), substituent(s), or parameters disclosed herein are thus also disclosed in combination with each other for the purposes of this description.

It is further understood that each lower limit of each range disclosed herein is to be interpreted as disclosed in combination with each upper limit of each range disclosed herein for the same component, compounds, substituent, or parameter. Thus, a disclosure of two ranges is to be interpreted as a disclosure of four ranges derived by combining each lower limit of each range with each upper limit of each range. A disclosure of three ranges is to be interpreted as a disclosure of nine ranges derived by combining each lower limit of each range with each upper limit of each range, etc. Furthermore, specific amounts/values of a component, compound, substituent, or parameter disclosed in the description or an example is to be interpreted as a disclosure of either a lower or an upper limit of a range and thus can be combined with any other lower or upper limit of a range or specific amount/value for the same component, compound, substituent, or parameter disclosed elsewhere in the application to form a range for that component, compound, substituent, or parameter.

The terms "oil composition," "lubrication composition," "lubricating oil composition," "lubricating oil," "lubricant composition," "lubricating composition," "fully formulated lubricant composition," "fully formulated lubricant," "fully formulated composition," "fully formulated oil composition," "finished oil," and "lubricant" are considered to be synonymous, fully interchangeable terms referring to the finished lubrication product comprising a major amount of a base oil plus a minor amount of an additive composition.

The terms, "crankcase oil," "crankcase lubricant," "engine oil," "engine lubricant," "motor oil," and "motor lubricant" are considered to be synonymous, fully interchangeable terms referring to the finished engine, motor or crankcase lubrication product comprising a major amount of a base oil plus a minor amount of an additive composition.

As used herein, the terms "additive package," "additive concentrate," and "additive composition," are considered to be synonymous, fully interchangeable terms referring the portion of the lubricating composition excluding the major amount of base oil stock. The additive package may or may not include a viscosity index improver or pour point depressant.

As used herein, the terms "engine oil additive package," "engine oil additive concentrate," "crankcase additive package," "crankcase additive concentrate," "motor oil additive package," and "motor oil concentrate," are considered to be synonymous, fully interchangeable terms referring the portion of the lubricating composition excluding the major amount of base oil stock. The engine, crankcase or motor oil additive package may or may not include a viscosity index improver or pour point depressant.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. "Group" and "moiety" as used herein are intended to be interchangeable. Examples of hydrocarbyl groups include:

(a) hydrocarbon substituents, that is, aliphatic substituents (e.g., alkyl or alkenyl), alicyclic substituents (e.g., cycloalkyl, cycloalkenyl), and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not materially alter the predominantly hydrocarbon character of the substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain atoms other than carbon atoms in a ring or chain otherwise composed of carbon atoms. Heteroatoms may include sulfur, oxygen, and nitrogen, and hetero substituents encompass substituents such as pyridyl, furyl, thienyl, and imidazolyl. In general, no more than two, for example or no more than one, non-hydrocarbon substituent will be present for every ten carbon atoms in the hydrocarbyl group. Typically, there are no non-hydrocarbon substituents in the hydrocarbyl group.

As used herein, the term "percent by weight", unless expressly stated otherwise, means the percentage that the recited component(s), compounds(s) or substituent(s) represents of the total weight of the entire composition.

The terms "soluble," "oil-soluble," and "dispersible" as used herein may, but do not necessarily, indicate that the compounds or additives are soluble, dissolvable, miscible, or capable of being suspended in the oil in all proportions. The foregoing terms do mean, however, that the component(s), compounds(s), or additive(s) are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular oil soluble, or dispersible compound or additive, if desired.

The term "TBN" as employed herein is used to denote the Total Base Number in mg KOH/g as measured by the method of ASTM D2896 or ASTM D4739.

The term "alkyl" as employed herein refers to straight, branched, cyclic, and/or substituted saturated moieties having a carbon chain of from about 1 to about 100 carbon atoms.

The term "alkenyl" as employed herein refers to straight, branched, cyclic, and/or substituted unsaturated moieties having a carbon chain of from about 3 to about 10 carbon atoms.

The term "aryl" as employed herein refers to single and multi-ring aromatic compounds that may include alkyl, alkenyl, alkylaryl, amino, hydroxyl, alkoxy, and/or halo substituents, and/or heteroatoms including, but not limited to, nitrogen, oxygen, and sulfur.

Lubricants, combinations of component(s) or compounds(s), or individual component(s) or compounds(s) of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or combinations thereof. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines to which the embodiments may be applied include marine diesel engines, aviation piston engines, low-load diesel engines, and motorcycle, automobile, locomotive, and truck engines.

The internal combustion engine may contain component(s) comprising one or more of an aluminum-alloy, lead, tin, copper, cast iron, magnesium, ceramics, stainless steel, composites, and/or combinations thereof. The component(s) may be coated, for example, with a diamond-like carbon coating, a lubricated coating, a phosphorus-containing coating, a molybdenum-containing coating, a graphite coating, a nanoparticle-containing coating, and/or combinations or mixtures thereof. The aluminum-alloy may include aluminum silicates, aluminum oxides, or other ceramic materials. In an embodiment the aluminum-alloy comprises an aluminum-silicate surface. As used herein, the term "aluminum alloy" is intended to be synonymous with "aluminum composite" and to describe a component or surface comprising aluminum and one or more other component(s) intermixed or reacted on a microscopic or nearly microscopic level, regardless of the detailed structure thereof. This would include any conventional alloys with metals other than aluminum as well as composite or alloy-like structures with non-metallic elements or compounds such as with ceramic-like materials.

The lubricant composition for an internal combustion engine may be suitable for any engine lubricant irrespective of the sulfur, phosphorus, or sulfated ash (ASTM D-874) content. The sulfur content of the engine lubricant may be about 1 wt. % or less, or about 0.8 wt. % or less, or about 0.5 wt. % or less, or about 0.3 wt. % or less. In an embodiment the sulfur content may be in the range of about 0.001 wt. % to about 0.5 wt. %, or about 0.01 wt. % to about 0.3 wt. %. The phosphorus content may be about 0.2 wt. % or less, or about 0.1 wt. % or less, or about 0.085 wt. % or less, or about 0.08 wt. % or less, or about 0.06 wt. % or less, about 0.055 wt. % or less, or about 0.05 wt. % or less. In an embodiment the phosphorus content may be about 50 ppm to about 1000 ppm, or about 325 ppm to about 850 ppm. The total sulfated ash content may be about 2 wt. % or less, or about 1.5 wt. % or less, or about 1.1 wt. % or less, or about 1 wt. % or less, or about 0.8 wt. % or less, or about 0.5 wt. % or less. In an embodiment the sulfated ash content may be about 0.05 wt. % to about 0.9 wt. %, or about 0.1 wt. % to about 0.7 wt. % or about 0.2 wt. % to about 0.45 wt. %. In another embodiment, the sulfur content may be about 0.4 wt. % or less, the phosphorus content may be about 0.08 wt. % or less, and the sulfated ash content may be about 1 wt. % or less. In yet another embodiment the sulfur content may be about 0.3 wt. % or less, the phosphorus content may be about 0.05 wt. % or less, and the sulfated ash may be about 0.8 wt. % or less.

In an embodiment the lubricating composition is may have: (i) a sulfur content of about 0.5 wt. % or less, (ii) a phosphorus content of about 0.1 wt. % or less, and (iii) a sulfated ash content of about 1.5 wt. % or less.

In an embodiment the lubricating composition is suitable for a 2-stroke or a 4-stroke marine diesel internal combustion engine. In an embodiment the marine diesel combustion engine is a 2-stroke engine.

Further, lubricants of the present description may be suitable to meet one or more industry specification requirements such as ILSAC GF-3, GF-4, GF-5, GF-6, PC-11, CI-4, CJ-4, ACEA A1/B1, A2/B2, A3/B3, A5/B5, C1, C2, C3, C4, E4/E6/E7/E9, Euro 5/6, Jaso DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, BMW Longlife-04, Porsche C30, Peugeot Citroën Automobiles B71 2290, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids, and manual transmission fluids, other hydraulic fluids, some gear oils, power steering fluids, fluids used in wind turbines and compressors, some industrial fluids, and fluids used in relation to power train component. It should be noted that within each class of these fluids such as, for example, automatic transmission fluids, there are a variety of different types of fluids due to the various apparatus/transmissions having different designs which have led to the need for specialized fluids having markedly different functional characteristics. This is contrasted by the term "lubricating fluid" which is used to denote a fluid that is not used to generate or transfer power as do the functional fluids.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When a functional fluid is an automatic transmission fluid, the automatic transmission fluid must have enough friction for the clutch plates to transfer power. However, the friction coefficient of such fluids has a tendency to decline due to temperature effects as the fluids heat up during operation. It is important that such tractor hydraulic fluids or automatic transmission fluids maintain a high friction coefficient at elevated temperatures, otherwise brake systems or automatic transmissions may fail. This is not a function of engine oils.

Tractor fluids, and for example Super Tractor Universal Oils (STUOs) or Universal Tractor Transmission Oils (UTTOs), may combine the performance of engine oils with one or more adaptations for transmissions, differentials, final-drive planetary gears, wet-brakes, and hydraulic performance. While many of the additives used to formulate a UTTO or a STUO fluid are similar in functionality, they may have deleterious effects if not incorporated properly. For example, some anti-wear and extreme pressure additives used in engine oils can be extremely corrosive to the copper component in hydraulic pumps. Detergents and dispersants used for gasoline or diesel engine performance may be detrimental to wet brake performance. Each of these fluids, whether functional, tractor, or lubricating, are designed to meet specific and stringent manufacturer requirements associated with their intended purpose.

Lubricating oil compositions of the present disclosure may be formulated in an appropriate base oil by the addition of one or more additives. The additives may be combined with the base oil in the form of an additive package (or concentrate) or, alternatively, may be combined individually with the base oil. The fully formulated lubricant may exhibit improved performance properties, based on the additives employed in the composition and the respective proportions of these additives.

The present disclosure includes novel lubricating oil blends specifically formulated for use as automotive crankcase lubricants. Embodiments of the present disclosure may provide lubricating oils suitable for crankcase applications and having improvements in the following characteristics: air entrainment, alcohol fuel compatibility, antioxidancy, anti-wear performance, biofuel compatibility, foam reducing properties, friction reduction, fuel economy, preignition prevention, rust inhibition, sludge and/or soot dispersability, and water tolerance.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only, and are not restrictive of the scope of the disclosure, as claimed.

DETAILED DESCRIPTION OF THE EMBODIMENT(S)

For illustrative purposes, the principles of the present disclosure are described by referencing various embodiments. Although certain embodiments of the disclosure are specifically described herein, one of ordinary skill in the art will readily recognize that the same principles are equally applicable to, and can be employed in, other systems and methods. Before explaining the disclosed embodiments of the present disclosure in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

In one aspect, the present disclosure provides a lubricating oil composition comprising a major amount of a base oil and a minor amount of an additive package, wherein the additive package comprises one or more friction modifier components selected from:

(A) one or more compounds of the formulae I and II:

(I)

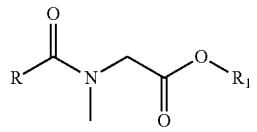

wherein R is a linear or branched, saturated, unsaturated, or partially saturated hydrocarbyl group having about 8 to about 22 carbon atoms and $R_1$ is a hydrocarbyl group having from about 1 to about 8 carbon atoms or a $C_1$-$C_8$ hydrocarbyl group containing one or more heteroatoms;

(II)

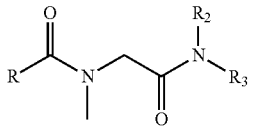

wherein R is a linear or branched, saturated, unsaturated, or partially saturated hydrocarbyl group having about 8 to about 22 carbon atoms and $R_2$ and $R_3$ are independently selected from hydrogen, $C_1$-$C_{18}$ hydrocarbyl groups, and $C_1$-$C_{18}$ hydrocarbyl groups containing one or more heteroatoms;

(B) at least two compounds independently selected from the formulae III and IV:

(III)

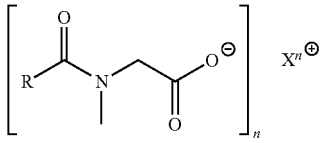

wherein R is a linear or branched, saturated, unsaturated, or partially saturated hydrocarbyl group having about 8 to about 22 carbon atoms; and X is an alkali metal, alkaline earth metal or ammonium cation and n is the valence of cation X;

(IV)

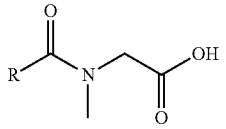

wherein R is a linear or branched, saturated, unsaturated, or partially saturated hydrocarbyl group having about 8 to about 22 carbon atoms; and (C) at least one compound of the formulae III and IV in combination with at least one compound of the formulae I and II.

Formulae I-III represent compounds which can be referred to as acyl N-methyl glycine derivatives since these compounds can be made by the reaction of acyl N-methyl glycines with various compounds as discussed in greater detail below. Compounds of the formulae I-IV function as friction modifiers when formulated in lubricating oils.

The friction modifiers represented by the Formulae I-IV may have an R group comprising from about 8 to about 22, or about 10 to about 20, or about 12 to about 18, or about 12 to about 16 carbon atoms.

In some embodiments, the friction modifiers of the present disclosure are compounds represented by the Formula I wherein $R_1$ is selected from a hydrocarbyl group having from about 1 to about 8 carbon atoms or a $C_1$-$C_8$ hydrocarbyl group containing one or more heteroatoms. The friction modifiers represented by the Formula I are esters. Some esters suitable for use in the present disclosure are ethyl ester of oleoyl sarcosine, ethyl ester of lauroyl sarcosine, butyl ester of oleoyl sarcosine, ethyl ester of cocoyl sarcosine, pentyl ester of lauroyl sarcosine, ethyl 2-(N-methyloctadeca-9-enamido)acetate, ethyl 2-(N-methyldodecanamido)acetate, butyl 2-(N-methyloctadeca-9-enamido)acetate, and pentyl 2-(N-methyldodecanamido)acetate. Unsaturated esters such as esters of 2-(N-methyltetradeca-9-enamido)acetic acid; 2-(N-methylhexadeca-9-enamido)acetic acid; 2-(N-methyloctadeca-9-enamido)acetic acid; 2-(N-methyloctadeca-9,12-dienamido) acetic acid and 2-(N-methyloctadeca-9,12,15-trienamido) acetic acid can also be employed.

The ester may be a reaction product of an acyl N-methyl glycine and at least one alcohol. The acyl N-methyl glycine with which the alcohol may be reacted may be represented by the Formula IV:

(IV)

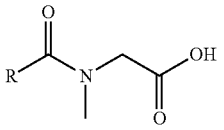

wherein R is a linear or branched, saturated, unsaturated, or partially saturated hydrocarbyl group having about 8 to about 22 carbon atoms and the hydroxy moiety on the acid group may also be replaced by a suitable leaving group, if desired, prior to reaction with the alcohol. The alcohol may be represented by $R_1$—OH, where $R_1$ comprises a $C_1$-$C_8$ hydrocarbyl group or a $C_1$-$C_8$ hydrocarbyl group containing one or more heteroatoms.

Some suitable compounds of the formula IV include oleoyl sarcosine, lauroyl sarcosine, cocoyl sarcosine, 2-(N-methyloctadeca-9-enamido)acetic acid, 2-(N-methyldodecanamido)acetic acid, 2-(N-methyltetradecanamido)acetic acid, 2-(N-methylhexadecanamido)acetic acid, 2-(N-methyloctadecanamido)acetic acid, 2-(N-methylicosanamido)acetic acid and 2-(N-methyldocosanamido)acetic acid.

Alcohols that are suitable for reaction with the compounds of the formula IV to produce friction modifiers in accordance with the present disclosure include straight or branched chain $C_1$-$C_8$ alcohols such as methanol, ethanol, n-propanol, isopropanol, n-butanol, isobutanol, tertiary butanol, pentanols such as n-pentanol, isopentanol, hexanols, heptanols, and octanols as well as unsaturated $C_1$-$C_8$ alcohols and heteroatom containing $C_1$-$C_8$ alcohols such as ethane-1,2-diol, 2-methoxyethanol, ester alcohols, or amino alcohols, such as triethanol amine. Ethanol, propyl alcohols, and butyl alcohols are useful for preparation of friction modifiers in accordance with the present disclosure.

In some embodiments, the friction modifiers of the present disclosure are represented by the formula II, wherein $R_2$ and $R_3$ are independently selected from hydrogen, hydrocarbyl groups having about 1 to about 18 carbon atoms, and heteroatom containing hydrocarbyl groups having about 1 to about 18 carbon atoms. In another embodiment, $R_2$ and $R_3$ may be independently selected from hydrocarbyl groups and heteroatom containing hydrocarbyl groups having about 3 to about 12 carbon atoms or hydrocarbyl groups and heteroatom containing hydrocarbyl groups having about 4 to about 8 carbon atoms. The friction modifiers represented by the formula II are amides.

The amides may be reaction products of one or more acyl N-methyl glycines or acyl N-methyl glycine derivatives and one or more amines. The acyl N-methyl glycine may be represented by the formula IV, as described herein. The amine may be represented by the formula V:

(V)

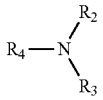

wherein $R_2$, $R_3$, and $R_4$ are the same or different and are independently selected from hydrogen, hydrocarbyl group, or heteroatom-containing hydrocarbyl group having from about 1 to about 18 or from 3 to about 12, or from about 4 to about 8 carbon atoms. Suitable amines include primary and secondary amines. Suitable amines include, for example, ammonia, 2-ethyl hexyl amine, n-butyl amine, t-butyl amine, isopropyl amine, pentyl amines including n-pentyl amine, isopentyl amine, 2-ethyl propyl amine, octyl amines, dibutylamine, and dimethylaminopropylamine. Suitable amides include, for example, the reaction products of compounds of the formula IV with one or more of methoxyethylamine, tris-hydroxymethyl amino-methane (THAM), and diethanolamine Another suitable amide reaction product is the reaction product of 2-(N-methyloctadeca-9-enamido)acetic acid and 2-ethyl hexyl amine.

In other embodiments, the friction modifiers of the present disclosure are in the form of metal or amine salts represented by the formula III wherein X is an alkali or alkaline earth metal cation, or an ammonium cation. Salts suitable as friction modifiers for use in the present disclosure include, for example, monovalent salts such as sodium, lithium, and potassium salts including, for example, the sodium salt of 2-(N-methyldodecanamido)acetic acid, the potassium salt of 2-(N-methyloctadecanamido)acetic acid, and divalent salts such as the calcium, magnesium, and barium salts.

The amine salts of the formula III may comprise ammonium cations selected from ammonium ion, as well as primary, secondary, or tertiary amine cations. The hydrocarbyl groups on the amine cation may be independently selected from hydrocarbyl groups containing from about 1 to about 18 carbon atoms, or from about 1 to about 12 carbon atoms, or from about 1 to about 8 carbon atoms. In an embodiment, the hydrocarbyl groups on the ammonium cation may have 14-18 carbon atoms. Suitable amine salts include the 2-ethyl hexyl amine salt of 2-(N-methyldodecanamido)acetic acid and the 2-ethyl butyl amine salt of 2-(N-methyloctadecanamido)acetic acid.

In another aspect, the present disclosure provides an engine oil composition comprising a major amount of a base oil and a minor amount of an additive package, wherein the additive package comprises one or more salts that are reaction products of:

one or more compounds of the formula IV:

(IV)

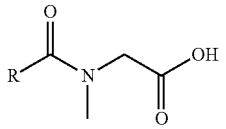

wherein R is a linear or branched, saturated, unsaturated, or partially saturated hydrocarbyl group having about 8 to about 22 carbon atoms, and one or more alkali or alkaline earth metal hydroxides, alkali or alkaline earth metal oxides, and mixtures thereof.

Suitable alkali or alkaline earth metal hydroxides or corresponding oxides include, but are not limited to, sodium hydroxide, potassium hydroxide, lithium hydroxide, calcium hydroxide, calcium oxide, magnesium hydroxide, barium hydroxide, and the like.

Suitable salts suitable as friction modifiers for use in the present disclosure include, for example, monovalent salts such as the sodium salt of 2-(N-methyldodecanamido)acetic acid, the potassium salt of 2-(N-methyloctadecanamido)acetic acid, divalent salts such as the calcium, magnesium, and barium salts.

In another aspect, the present disclosure provides a lubricating oil composition comprising a major amount of a base oil and a minor amount of an additive package, wherein the additive package comprises one or more reaction products of:

one or more compounds of the formula IV:

(IV)

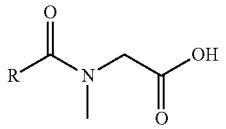

wherein R is a linear or branched, saturated, unsaturated, or partially saturated hydrocarbyl group having about 8 to about 22 carbon atoms, and one or more amine alcohol(s).

Suitable amine alcohols include, but are not limited to, ethanolamine, diethanolamine, aminoethyl ethanolamine, tris-hydroxymethyl amino-methane (THAM), and the like, as well as mixtures thereof.

In some embodiments, the lubricating oil composition is an engine oil.

In some embodiments the reaction product of Formula (IV) and an amine alcohol may comprise or consist of a mixture of amides and esters.

In an embodiment, the disclosure comprises one or more reaction products of one or more compounds of the formula IV:

(IV)

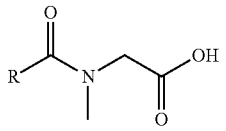

wherein R is a linear or branched, saturated, unsaturated, or partially saturated hydrocarbyl group having about 8 to about 22 carbon atoms, and one or more amines of the formula V:

(V)

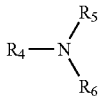

wherein $R_4$, $R_5$, and $R_6$ are independently selected from hydrogen, $C_1$-$C_{18}$ hydrocarbyl groups and heteroatom containing $C_1$-$C_{18}$ hydrocarbyl groups. The amines listed herein may be used in this reaction. These reaction products may comprise or consist of one or more amides.

The present disclosure also includes a lubricating oil composition comprising a major amount of a base oil and a minor amount of an additive package, wherein the additive package comprises one or more reaction products of:

one or more compounds of the formula IV:

(IV)

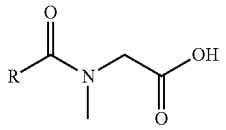

wherein R is a linear or branched, saturated, unsaturated, or partially saturated hydrocarbyl group having about 8 to about 22 carbon atoms and the hydrogen atom on the acid group may also be replaced by a suitable leaving group; and one or more alcohols represented by $R_1$—OH, where $R_1$ comprises a hydrocarbyl group or $C_1$-$C_8$ hydrocarbyl groups containing one or more heteroatoms. The alcohols listed herein may be used in this reaction. These reaction products may comprise or consist of one or more esters.

In some embodiments, the lubricating oil composition is an engine oil.

The present disclosure also includes an engine oil composition comprising a major amount of a base oil and a minor amount of an additive package, wherein the additive package comprises one or more ammonium salts that are reaction products of:

one or more compounds of the formula IV:

(IV)

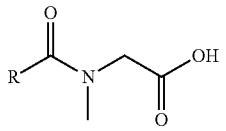

wherein R is a linear or branched, saturated, unsaturated, or partially saturated hydrocarbyl group having about 8 to about 22 carbon atoms; and an amine of the formula V:

(V)

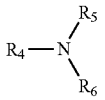

wherein $R_4$, $R_5$, and $R_6$ are independently selected from hydrogen, $C_1$-$C_{18}$ hydrocarbyl groups and heteroatom containing $C_1$-$C_{18}$ hydrocarbyl groups.

The amines used to produce amine salts by the reaction of compounds of the formula IV and one or more amines may comprise amines that provide ammonium ions or primary, secondary, or tertiary amine cations. The hydrocarbyl groups on the amine cation may be independently selected from hydrocarbyl groups containing from about 1 to about 18 carbon atoms, or from about 1 to about 12 carbon atoms, or from about 1 to about 8 carbon atoms. In an embodiment, the hydrocarbyl groups on the ammonium cation may have 14-18 carbon atoms.

In another aspect, the present disclosure provides a lubricating oil composition comprising a major amount of a base oil and a minor amount of an additive package, wherein the additive package comprises one or more reaction products of:

one or more compounds of the formula IV:

(IV)

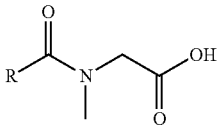

wherein R is a linear or branched, saturated, unsaturated, or partially saturated hydrocarbyl group having about 8 to about 22 carbon atoms; and mixtures of two or more of the reactants described herein for reaction with compounds of the formula IV. One particularly suitable combination comprises the reaction products of compounds of the formula IV with one or more alcohols; and one or more alkali metal or alkaline earth metal hydroxides, alkali metal, or alkaline earth metal oxides or amines of the formula V.

The alcohols which may be used to make these reaction products are the same alcohols as described herein. The alkali metal or alkaline earth metal hydroxides and alkali metal or alkaline earth metal oxides are the same as those described herein. These reaction products may comprise or consist of a combination of esters of the formula I and alkali metal, alkaline earth metal, or ammonium salts of the formula III.

In some embodiments of the disclosure, compounds of the formulae III and IV may also be used as friction modifiers. In such embodiments, wherein compounds of the formulae III and IV are used, two or more friction modifiers are employed. Thus, in some embodiments, the lubricating or engine oil compositions of the present disclosure may contain two or more friction modifiers each independently selected from the formulae I-IV and the reaction products of alcohols, ammonia, amines, amino alcohols, alkali or alkaline earth metal hydroxides, alkali or alkaline earth metal oxides, and mixtures thereof with compounds of the formula IV, as described herein. Such embodiments are useful for tailoring specific properties of lubricating oils and, for example, engine oils.

Mixtures of friction modifiers may include, but are not limited to, a mixture of 2-(N-methyloctadecanamido)acetic acid and 2-(N-methyldodecanamido)acetic acid; a mixture of 2-(N-methyloctadecanamido)acetic acid and the ethyl 2-(N-methyloctadeca-9-enamido)acetate; a mixture of cocoyl sarcosine and the ethyl ester of cocoyl sarcosine; a mixture of the ethyl 2-(N-methyloctadeca-9-enamido)acetate and the ethyl 2-(N-methyldodecanamido)acetate; a mixture of 2-(N-methyloctadeca-9-enamido)acetic acid and 2-(N-methyldodecanamido)acetic acid; a mixture of the ethyl 2-(N-methyloctadeca-9-enamido)acetate and the ethyl ester of cocoyl sarcosine; a mixture of the ethyl 2-(N-methyldodecanamido)acetate and the ethyl ester of cocoyl sarcosine; and a mixture of the ethyl 2-(N-methyloctadeca-9-enamido)acetate, the ethyl 2-(N-methyldodecanamido)acetate, and the ethyl ester of cocoyl sarcosine.

Each of the lubricating oils described herein may be formulated as engine oils.

In another aspect, the present disclosure relates to a method of using any of the lubricating oils described herein for improving or reducing thin film friction. In another aspect, the present disclosure relates to a method of using any of the lubricating oils described herein for improving or reducing boundary layer friction. In another aspect, the present disclosure relates to a method of using any of the lubricating oils described herein for improving or reducing both thin film friction and boundary layer friction. These methods can be used for lubrication of surfaces of any type described herein.

In yet another aspect, the present disclosure provides a method for improving thin film and boundary layer friction in an engine comprising the step of lubricating the engine with an engine oil comprising a major amount of a base oil and a minor amount of an additive package comprising a friction modifier as disclosed herein. Suitable friction modifiers are those of the formulae I-III described herein. Also suitable are the reaction products of one or more amines of the formula V and one or more compounds of the formula IV. Also suitable are mixtures of two or more friction modifiers each independently selected from the formulae I-IV as well as the reaction products of alcohols, amino alcohols, ammonia, amines, alkali metal or alkaline earth metal hydroxides, alkali metal or alkaline earth metal oxides and mixtures thereof, with compounds of the formula IV, as described herein.

In yet another aspect, the present disclosure provides a method for improving boundary layer friction in an engine comprising the step of lubricating the engine with an engine oil comprising a major amount of a base oil and a minor amount of an additive package comprising a friction modifier as disclosed herein. Suitable friction modifiers are those of the formulae I-III described herein. Also suitable are the reaction products of one or more amines of the formula V and one or more compounds of the formula IV. Two or more friction modifiers each independently selected from the formulae I-IV as well as the reaction products of alcohols, amino alcohols, ammonia, amines, alkali metal or alkaline earth metal hydroxides, alkali metal or alkaline earth metal oxides, and mixtures thereof, with compounds of the formula IV, as described herein.

In yet another aspect, the present disclosure provides a method for improving thin film friction in an engine comprising the step of lubricating the engine with an engine oil comprising a major amount of a base oil and a minor amount of an additive package comprising a friction modifier as disclosed herein. Suitable friction modifiers are those of the formulae I-III described herein. Also suitable are the reaction products of one or more amines of the formula V and one or more compounds of the formula IV. Two or more friction modifiers each independently selected from the formulae I-IV and the reaction products of alcohols, amino alcohols, ammonia, amines, alkali metal or alkaline earth metal hydroxides, alkali metal or alkaline earth metal oxides, and mixtures thereof, with compounds of the formula IV, as described herein.

The one or more friction modifiers of the present disclosure may comprise from about 0.05 to about 2.0 wt. %, or about 0.1 to about 2.0 wt. %, or about 0.2 to about 1.8 wt. %, or about 0.5 to about 1.5 wt. % of the total weight of the lubricating oil composition. Suitable amounts of the compounds of the friction modifiers may be incorporated in additive packages to deliver the proper amount of friction modifier to the fully formulated engine oil. The one or more friction modifiers of the present disclosure may comprise from about 0.1 to about 20 wt. %, or about 1.0 to about 20 wt. %, or about 2.0 to about 18 wt. %, or about 5.0 to about 15 wt. % of the total weight of the additive package.

The one or more friction modifiers when used in combination may be used in a ratio of from 1:100 to 100:1; from 1:1:100 to 1:100:1 to 100:1:1; or any other suitable ratio and so on.

The additive package and lubricating and engine oils of the present disclosure may further comprise one or more optional components. Some examples of these optional components include antioxidants, antiwear agents, boron-containing compounds, detergents, dispersants, extreme pressure agents, other friction modifiers in addition to the friction modifiers of the present disclosure, phosphorus-containing compounds, molybdenum-containing compounds, antifoam agents, titanium-containing compounds, viscosity index improvers, pour point depressants, and diluent oils. Other optional components that may be included in the additive package of the additive package and the lubricating and engine oils of the present disclosure are described below.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may sometimes be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source with or without little further purification treatment. Refined oils are similar to unrefined oils except that they have been treated by one or more purification steps, which may result in the improvement of one or more properties. Examples of suitable purification techniques are solvent extraction, secondary distillation, acid or base extraction, filtration, percolation, and the like. Oils refined to the quality of an edible oil may or may not be useful. Edible oils may also be called white oils. In some embodiments, lubricant compositions are free of edible or white oils.

Re-refined oils are also known as reclaimed or reprocessed oils. These oils are obtained in a manner similar to that used to obtain refined oils using the same or similar processes. Often these oils are additionally processed by techniques directed to removal of spent additives and oil breakdown products.

Mineral oils may include oils obtained by drilling, or from plants and animals and mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully-hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In an embodiment, oils may be prepared by a Fischer-Tropsch gas-to-liquid synthetic procedure as well as from other gas-to-liquid oils.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

Antioxidants

The lubricating oil compositions herein also may optionally contain one or more antioxidants. Antioxidant compounds are known and include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidants may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight of the antioxidant, based upon the final weight of the lubricating oil composition. In some embodiments, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as $\alpha$-olefins.

The one or more antioxidant(s) may be present in ranges of from about 0 wt. % to about 20 wt. %, or about 0.1 wt. % to about 10 wt. %, or about 1 wt. % to about 5 wt. %, of the lubricating composition.

Antiwear Agents

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. The phosphorus containing antiwear agents are more fully described in European Patent No. 0612 839. The metal in the dialkyl dithio phosphate salts may be an alkali metal, alkaline earth metal, aluminum, lead, tin, molybdenum, manganese, nickel, copper, titanium, or zinc. A useful antiwear agent may be a zinc dialkyldithiophosphate.

The antiwear agent may be present in ranges of from about 0 wt. % to about 15 wt. %, or about 0.01 wt. % to about 10 wt. %, or about 0.05 wt. % to about 5 wt. %, or about 0.1 wt. % to about 3 wt. % of the total weight of the lubricating composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt. %, about 0.01 wt. % to about 7 wt. %, about 0.05 wt. % to about 5 wt. %, or about 0.1 wt. % to about 3 wt. % of the total weight of the lubricating composition.

Detergents

The lubricant composition may optionally comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds and methylene bridged phenols. Suitable detergents and their methods of preparation are described in greater detail in numerous patent publications, including U.S. Pat. No. 7,732,390, and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being one of benzyl, tolyl, and xylyl.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols.

The overbased detergent may have a metal ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt. % to about 10 wt. %, or about 0.1 wt. % to about 8 wt. %, or about 1 wt. % to about 4 wt. %, or greater than about 4 wt. % to about 8 wt. % based on the total weight of the lubricant composition.

Dispersants

The lubricant composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in a range of about 350 to about 5000, or about 500 to about 3000. Succinimide dispersants and their preparation are disclosed, for instance in U.S. Pat. No. 7,897,696 and U.S. Pat. No. 4,234,435. Succinimide dispersants are typically an imide formed from a polyamine, typically a poly(ethyleneamine).

In some embodiments the lubricant composition comprises at least one polyisobutylene succinimide dispersant derived from polyisobutylene with number average molecular weight in the range about 350 to about 5000, or about 500 to about 3000. The polyisobutylene succinimide may be used alone or in combination with other dispersants.

In some embodiments, polyisobutylene (PIB), when included, may have greater than 50 mol %, greater than 60 mol %, greater than 70 mol %, greater than 80 mol %, or greater than 90 mol % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. No. 4,152,499 and U.S. Pat. No. 5,739,355. When used in the aforementioned thermal Ene reaction, HR-PIB may lead to higher conversion rates in the reaction, as well as lower amounts of sediment formation, due to increased reactivity.

In embodiments the lubricant composition comprises at least one dispersant derived from polyisobutylene succinic anhydride.

In an embodiment, the dispersant may be derived from a polyalphaolefin (PAO) succinic anhydride.

In an embodiment, the dispersant may be derived from olefin maleic anhydride copolymer. As an example, the dispersant may be described as a poly-PIBSA.

In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. No. 7,645,726; U.S. Pat. No. 7,214,649; and U.S. Pat. No. 8,048,831 describe some suitable post-treatment methods and post-treated products.

The dispersant, if present, can be used in an amount sufficient to provide up to about 20 wt. %, based upon the total weight of the lubricating oil composition. The amount of the dispersant that can be used may be about 0.1 wt. % to about 15 wt. %, or about 0.1 wt. % to about 10 wt. %, or about 3 wt. % to about 10 wt. %, or about 1 wt. % to about 6 wt. %, or about 7 wt. % to about 12 wt. %, based upon the total weight of the lubricating oil composition. In an embodiment, the lubricating oil composition utilizes a mixed dispersant system.

Extreme Pressure Agents

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

The lubricating oil compositions herein may also optionally contain one or more additional friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidines, alkanolamides, phosphonates, metal-containing compounds, glycerol esters, sulfurized fatty compounds and olefins, sunflower oil and other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In a embodiments the friction modifier may be a long chain fatty acid ester. In an embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may be present in amounts of about 0 wt. % to about 10 wt. %, or about 0.01 wt. % to about 8 wt. %, or about 0.1 wt. % to about 4 wt. %, based on the total weight of the lubricant composition.

Molybdenum-Containing Components

The lubricating oil compositions herein may also contain one or more molybdenum-containing compounds. An oil-soluble molybdenum compound may have the functional performance of an antiwear agent, an antioxidant, a friction modifier, or any combination of these functions. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In an embodiment the oil-soluble molybdenum compound may be selected from the group consisting of molybdenum dithiocarbamates, molybdenum dialkyldithiophosphates, amine salts of molybdenum compounds, and mixtures thereof. In an embodiment the oil-soluble molybdenum compound may be a molybdenum dithiocarbamate.

Suitable examples of molybdenum compounds which may be used include commercial materials sold under trade names such as Molyvan 822™, Molyvan™ A, Molyvan 2000® and Molyvan 855™ from R. T. Vanderbilt Co., Ltd., and Sakura-Lube™ S-165, S-200, S-300, S-310G, S-525, S-600, S-700, and S-710, available from Adeka Corporation, and mixtures thereof. Suitable molybdenum compounds are described in U.S. Pat. No. 5,650,381; and U.S. Reissue Pat. Nos. Re 37,363 E1; Re 38,929 E1; and Re 40,595 E1.

Additionally, the molybdenum compound may be an acidic molybdenum compound. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, or at least 25, at least 30, or at least 35 carbon atoms. Additional suitable molybdenum compounds are described in U.S. Pat. No. 6,723,685.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum in the lubricant composition.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The lubricating oil compositions herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. % based on the total weight, of the lubricating composition.

Other Optional Additives

Other additives may be selected to perform one or more functions required of a lubricating fluid. Further, one or more of the mentioned additives may be multi-functional and provide other functions in addition to or other than the function prescribed herein.

A lubricating composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxanes.

Suitable pour point depressants may include polymethylmethacrylates or mixtures thereof. Pour point depressants may be present in an amount sufficient to provide from about 0 wt. % to about 1 wt. %, about 0.01 wt. % to about 0.5 wt. %, or about 0.02 wt. % to about 0.04 wt. %, based upon the total weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, the lubricating composition or engine oil is devoid of a rust inhibitor.

The rust inhibitor can be used in an amount sufficient to provide about 0 wt. % to about 5 wt. %, about 0.01 wt. % to about 3 wt. %, about 0.1 wt. % to about 2 wt. %, based upon the total weight of the lubricating oil composition.

In general terms, a suitable crankcase lubricant may include additive component(s) in the ranges listed in the following table.

TABLE 2

| Component | Wt. % (Suitable Embodiments) | Wt. % (Suitable Embodiments) |
|---|---|---|
| Dispersant(s) | 0.1-10.0 | 1.0-5.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-20.0 | 0.25-10.0 |
| Friction modifier(s) | 0.01-5.0 | 0.05-2.0 |
| Base oil(s) | Balance | Balance |
| Total | 100 | 100 |

The percentages of each component above represent the total weight percent of each component, based upon the total weight of the final lubricating oil composition. The remainder or balance of the lubricating oil composition consists of one or more base oils.

Additives used in formulating the compositions described herein may be blended into the base oil individually or in various sub-combinations. However, it may be suitable to blend all of the component(s) concurrently using an additive concentrate (i.e., additives plus a diluent, such as a hydrocarbon solvent).

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the scope of the disclosure.

Examples of engine oils according to the present disclosure have been prepared using friction modifiers of the present disclosure. The friction modifiers employed in these examples were as follows:

Example 1

Oleoyl Butyl Sarcosinate (BuOS)

A 500 mL resin kettle equipped with overhead stirrer, Dean Stark trap, and a thermocouple was charged with 281 g (0.8 mol) oleoyl sarcosine, 237 g butanol, and 0.38 g Amberlyst 15 acidic resin. The reaction mixture was heated with stirring under nitrogen at reflux for 3 h removing 25 mL aliquots every 30 minutes. The reaction mixture was then concentrated in vacuo and filtered affording 310 g of product.

Example 2

Oleoyl Ethyl Sarcosinate (EtOS)

A 500 mL resin kettle equipped with overhead stirrer, Dean Stark trap, and a thermocouple was charged with 281 g (0.8 mol) oleoyl sarcosine and 295 g ethanol. The reaction mixture was heated with stirring under nitrogen at reflux for 3 h removing 25 mL aliquots every 30 minutes. The reaction mixture was then concentrated in vacuo affording 280 g of product.

Example 3

Lauroyl Ethyl Sarcosinate (EtLS)

A 500 mL resin kettle equipped with overhead stirrer, Dean Stark trap, and a thermocouple was charged with 128.5 g (0.5 mol) lauroyl sarcosine and 345.5 g ethanol. The reaction mixture was heated with stirring under nitrogen at reflux for 3 h removing 25 mL aliquots every 30 minutes. The reaction mixture was then concentrated in vacuo affording 126.2 g of product.

Example 4

Cocoyl Ethyl Sarcosinate (EtCS)

A 500 mL resin kettle equipped with overhead stirrer, Dean Stark trap, and a thermocouple was charged with 200 g (0.71 mol) cocoyl sarcosine and 329 g ethanol. The reaction mixture was heated with stirring under nitrogen at reflux for 3 h removing 25 mL aliquots every 30 minutes. The reaction mixture was then concentrated in vacuo affording 201 g of product.

Example 5

Oleoyl 2-Ethylhexyl Sarcosinate

A 500 mL resin kettle equipped with overhead stirrer, Dean Stark trap, and a thermocouple was charged with 175.6 g (0.5 mol) oleoyl sarcosine and 65.1 g 2-ethylhexanol. The reaction mixture was heated with stirring under nitrogen at 150° C. for 3 h removing. The reaction mixture was then concentrated in vacuo affording 421.7 g of product.

Example 6

Oleoyl 2-methoxyethyl sarcosinate (MeOEt-OS)

A 500 mL resin kettle equipped with overhead stirrer, Dean Stark trap, and a thermocouple was charged with 140.4 g (0.4 mol) oleoyl sarcosine, 48.1 g ethylene glycol methyl ether, and 1.0 g of Amberlyst 15 acidic resin. The reaction mixture was heated with stirring under nitrogen at 160° C. for 3 h. The reaction mixture was then concentrated in vacuo diluted with 181.3 g process oil and filtered affording 273.5 g of product.

Example 7

Oleoyl 2-hydroxyethyl sarcosinate (HOEt-OS)

A 500 mL resin kettle equipped with overhead stirrer, Dean Stark trap, and a thermocouple was charged with 175.5 g (0.5 mol) oleoyl sarcosine, 32 g ethylene glycol, and 1.0 g of Amberlyst 15 acidic resin. The reaction mixture was heated with stirring under nitrogen at 160° C. for 3 h. The reaction mixture was then concentrated in vacuo diluted with 198.5 g process oil and filtered affording 312.7 g of product.

Example 8

Lauroyl 2-hydroxyethyl sarcosinate (HO-EtLS)

A 500 mL resin kettle equipped with overhead stirrer, Dean Stark trap, and a thermocouple was charged with 128.5 g (0.5 mol) lauroyl sarcosine and 32 g ethylene glycol. The reaction mixture was heated with stirring under nitrogen at 160° C. for 3 h. The reaction mixture was then concentrated in vacuo diluted with 151.5 g process oil affording 277.5 g of product.

Example 9

N-oleoyl-N'-2 ethylhexylsarcosinamide

A 500 mL resin kettle equipped with overhead stirrer, Dean Stark trap, and a thermocouple was charged with 107 g (0.31 mol) oleoyl sarcosine and 39.4 g 2-ethyl-1-hexylamine. The reaction mixture was heated with stirring under nitrogen at 130° C. for 3 h. The reaction mixture was then concentrated in vacuo affording 266.6 g of product.

Example 10

N-oleoyl-N'-2 methoxyethylsarcosinamide

A 500 mL resin kettle equipped with overhead stirrer, Dean Stark trap, and a thermocouple was charged with 140.4 g (0.4 mol) oleoyl sarcosine, 30 g methoxyethylamine, and 1.0 g of Amberlyst 15 acidic resin. The reaction mixture was heated with stirring under nitrogen at 150° C. for 3 h. The reaction mixture was then concentrated in vacuo, diluted with 163.2 g process oil and filtered affording 263.9 g of product.

Example 11

N-oleoyl-N'-3 dimethylaminopropylsarcosinamide

A 500 mL resin kettle equipped with overhead stirrer, Dean Stark trap, and a thermocouple was charged with 175.5 g (0.5 mol) oleoyl sarcosine, 51.1 g 3-dimethylamino-propylamine, and 1.0 g of Amberlyst 15 acidic resin. The reaction mixture was heated with stirring under nitrogen at 150° C. for 3 h. The reaction mixture was then concentrated in vacuo, diluted with 217.6 g process oil and filtered affording 377.8 g of product.

Example 12

N-oleoyl-N',N' bis(2-hydroxyethyl)sarcosinamide

A 500 mL resin kettle equipped with overhead stirrer, Dean Stark trap, and a thermocouple was charged with 175.5 g (0.5 mol) oleoyl sarcosine, 52.6 g diethanolamine, and 1.0 g of Amberlyst 15 acidic resin. The reaction mixture was heated with stirring under nitrogen at 150° C. for 3 h. The reaction mixture was then concentrated in vacuo diluted with 219 g process oil and filtered affording 371.6 g of product.

Example 13

Sodium Lauroyl sarcosine, such as HAMPOSYL® L-95, available from Chattem Chemicals Example 14

Cocoyl Sarcosine, Such as CRODASINIC™ C, Available from Croda Inc

Example 15

Lauroyl Sarcosine, Such as CRODASINIC™ L, Available from Croda Inc

Example 16

Oleoyl Sarcosine, Such as CRODASINIC™ O, Available from Croda Inc. or Such as HAMPOSYL® O, Available from Chattem Chemicals Example 17

Stearoyl Sarcosine and Myristoyl Sarcosine Mixture, Such as CRODASINIC™ SM, Available from Croda Inc

TABLE 3

| | |
|---|---|
| Example 1 | Oleoyl butylsarcosinate |
| Example 2 | Oleoyl ethylsarcosinate |
| Example 3 | Lauroyl ethylsarcosinate |
| Example 4 | Cocoyl ethylsarcosinate |
| Example 5 | Oleoyl 2-ethylhexylsarcosinate |
| Example 6 | Oleoyl methyoxyethylsarcosinate |
| Example 7 | Oleoyl hydroxyethyl sarcosinate |
| Example 8 | Lauroyl hydroxyethyl sarcosinate |
| Example 9 | N-oleoyl-N'-2 ethylhexylsarcosinamide |
| Example 10 | N-oleoyl-N'-2 methoxyethylsarcosinamide |
| Example 11 | N-oleoyl-N'-3 dimethylaminopropylsarcosinamide |
| Example 12 | N-oleoyl-N',N' bis(2-hydroxyethyl)sarcosinamide |
| Example 13 | Hamposyl L-95 |
| Example 14 | Cocoyl sarcosine |
| Example 15 | Lauroyl sarcosine |
| Example 16 | Oleoyl sarcosine |
| Example 17 | Stearoyl sarcosine with Myristoyl sarcosine |

The engine lubricants were subjected to High Frequency Reciprocating Rig (HFRR) test and thin film friction (TFF) tests. A HFRR from PCS Instruments was used for measuring boundary lubrication regime friction coefficients. The friction coefficients were measured at 130° C. between an SAE 52100 metal ball and an SAE 52100 metal disk. The ball was oscillated across the disk at a frequency of 20 Hz over a 1 mm path, with an applied load of 4.0 N. The ability of the lubricant to reduce boundary layer friction is reflected by the determined boundary lubrication regime friction coefficients. A lower value is indicative of lower friction.

The TFF test measures thin-film lubrication regime traction coefficients using a Mini-Traction Machine (MTM) from PCS Instruments. These traction coefficients were measured at 130° C. with an applied load of 35N between an ANSI 52100 steel disk and an ANSI 52100 steel ball as oil was being pulled through the contact zone at an entrainment speed of 500 mm/s. A slide-to-roll ratio of 20% between the ball and disk was maintained during the measurements. The ability of lubricant to reduce thin film friction is reflected by the determined thin-film lubrication regime traction coefficients. A lower value is indicative of lower friction.

The results of the HFRR and TFF tests for formulations including one or more friction modifiers of Table 3 above are shown in Tables 4-7. Unless otherwise indicated, blends of friction modifiers used in the examples were 50/50 wt. % blends. The data for Table 4 was generated at a treat rate of 0.5 wt. % of active friction modifier listed in the table and, in the case of mixtures, the treat rate of the mixture was 0.5 wt. % of the total mixture of the active friction modifier.

The base lubricating composition used in the blends of Table 4 included only a base oil and an all primary zinc dialkyl dithio phosphate that delivered about 800 ppm of phosphorus to the composition. Comparative Blend A included only this same base lubricating composition without any added friction modifier (FM).

Test results for lubricants with two or more friction modifiers including at least one friction modifier of the present disclosure are given in Table 4. The results show that oil lubricants including two or more friction modifiers can be used to effectively reduce and/or tailor the boundary layer friction.

TABLE 4

| Test Oil | Friction Modifier | HFRR (130° C.) |
|---|---|---|
| Comparative Blend A | No FM | 0.138 |
| Blend 1 | Example 2 | 0.084 |
| Blend 1 | Example 3 | 0.130 |
| Blend 2 | Example 4 | 0.132 |
| Blend 3 | Example 9 | 0.135 |
| Blend 4 | A mixture of examples 14 and 16 | 0.120 |
| Blend 5 | A mixture of examples 16 and 17 | 0.103 |
| Blend 6 | A mixture of examples 2 and 16 | 0.126 |
| Blend 7 | A mixture of examples 4 and 14 | 0.127 |
| Blend 8 | A mixture of examples 2 and 4 | 0.125 |
| Blend 9 | A mixture of examples 2 and 3 | 0.130 |
| Blend 10 | A mixture of examples 3 and 4 | 0.135 |
| Blend 11 | A mixture of examples 2, 3, and 4 | 0.129 |

The base lubricating composition used in the blend of Table 5 was an SAE 5W-20 GF-5 quality oil formulated without a friction modifier. Comparative Blend B included only this same base lubricating composition without any added friction modifier (FM). The data for Table 5 was generated at a treat rate of 0.5 wt. % of active friction modifier listed in the table.

TABLE 5

| Test Oil | Friction Modifier | HFRR 130° C. | MTM 130° C. |
|---|---|---|---|
| Comparative Blend B | No FM | 0.160 | 0.092 |
| Blend 12 | Example 1 | 0.139 | 0.083 |
| Blend 13 | Example 2 | 0.079 | 0.044 |
| Blend 14 | Example 13 | 0.098 | 0.090 |

The base lubricating composition used in the blends of Tables 6-7 was an SAE 5W-20 GF-5 quality oil formulated without a friction modifier.

TABLE 6

| Test Blend | Friction Modifiers | Treat Rate | HFRR 130° C. | TFF 130° C. |
|---|---|---|---|---|
| Comparative Blend B | No FM | 0.0 | 0.160 | 0.092 |
| Blend 15 | A mixture of examples 15 and 16 | 0.05 | 0.161 | 0.086 |
| Blend 16 | A mixture of examples 15 and 16 | 0.1 | 0.150 | 0.074 |
| Blend 17 | A mixture of examples 15 and 16 | 0.25 | 0.108 | 0.064 |
| Blend 18 | A mixture of examples 15 and 16 | 0.5 | 0.078 | 0.044 |
| Blend 19 | A mixture of examples 15 and 16 | 0.75 | 0.078 | 0.036 |
| Blend 20 | A mixture of examples 15 and 16 | 1.0 | 0.076 | 0.040 |

The HFRR and TFF data of these examples show that the mixtures of friction modifiers in accordance with the present disclosure were more effective than no friction modifier. The blends of Table 6 were demonstrated to be effective to reduce at least one of HFRR and TFF at least when used at ranges of amounts of from 0.05 to 1.0 wt. % of a 50/50 blend of the components. Further, the blends of Table 6 were demonstrated to be effective to reduce TFF at least when used at ranges of amounts of from 0.05 to 1.0 wt. % of a 50/50 blend of the components.

TABLE 7

| Test Blends | Example 15 Treat Rate | Example 16 Treat Rate | HFRR 130° C. | MTM 130° C. |
|---|---|---|---|---|
| Comparative Blend B | No FM | 0.0 | 0.160 | 0.092 |
| Blend 21 | 0.40 | 0.10 | 0.086 | 0.048 |
| Blend 22 | 0.30 | 0.20 | 0.079 | 0.047 |
| Blend 23 | 0.25 | 0.25 | 0.078 | 0.044 |
| Blend 24 | 0.20 | 0.30 | 0.077 | 0.048 |
| Blend 25 | 0.10 | 0.40 | 0.078 | 0.048 |

The blends of Table 7 were demonstrated to be effective at least when used at ranges of amounts 4:1 to 1:4 as a blend of the two friction modifiers. The HFRR and TFF data of these examples show that the mixtures of friction modifiers in accordance with the present disclosure were more effective than no friction modifier. The blends of Table 7 were demonstrated to be effective to reduce both HFRR and TFF at ranges of amounts 4:1 to 1:4 as a blend of the two friction modifiers.

From Tables 4 to 7 it is clear that each of the compounds of the present disclosure effectively function as friction modifiers. The coefficient of friction for boundary layer friction (HFRR) is significantly lower when oils in accordance with the present disclosure are employed, as compared with oils with no friction modifiers. The coefficient of friction for thin film friction (TFF) is also generally lower when oils of the present disclosure are employed, as compared to lubricants with no friction modifiers. It is apparent from these tests that oils according to the present disclosure effectively reduce both boundary layer friction and thin film friction.

Other embodiments of the present disclosure will be apparent to those skilled in the art from consideration of the specification and practice of the embodiments disclosed herein. It is intended that the specification and examples be considered as exemplary only, with a true scope of the disclosure being indicated by the following claims.

The foregoing embodiments are susceptible to considerable variation in practice. Accordingly, the embodiments are not intended to be limited to the specific exemplifications set forth herein. Rather, the foregoing embodiments are within the spirit and scope of the appended claims, including the equivalents thereof available as a matter of law.

All documents mentioned herein are hereby incorporated by reference in their entirety or alternatively to provide the disclosure for which they were specifically relied upon.

The applicant(s) do not intend to dedicate any disclosed embodiments to the public, and to the extent any disclosed modifications or alterations may not literally fall within the scope of the claims, they are considered to be part hereof under the doctrine of equivalents.

What is claimed is:

1. An engine oil composition comprising a major amount of base oil having at least 90% saturates and being selected from the group consisting of a Group II, Group III, Group IV and Group V base oil and mixtures thereof, and a minor amount of an additive package, wherein the additive package comprises one or more friction modifier components selected from the group consisting of:

(A) one or more compounds of the formulae I and II:

(I)

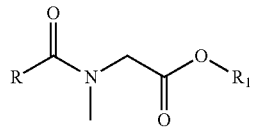

wherein R is a linear or branched, saturated, unsaturated, or partially saturated hydrocarbyl group having about 8 to about 22 carbon atoms and $R_1$ is a hydrocarbyl having from about 1 to about 8 carbon atoms or a $C_1$-$C_8$ hydrocarbyl group containing one or more heteroatoms;

(II)

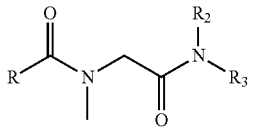

wherein R is a linear or branched, saturated, unsaturated, or partially saturated hydrocarbyl group having about 8 to about 22 carbon atoms and $R_2$ and $R_3$ are independently selected from the group consisting of hydrogen, $C_1$-$C_{18}$ hydrocarbyl groups, and $C_1$-$C_{18}$ hydrocarbyl groups containing one or more heteroatoms;

(B) two or more compounds independently selected from the group consisting of compounds of the formulae III and IV:

(III)

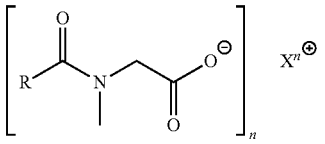

wherein R is a linear or branched, saturated, unsaturated, or partially saturated hydrocarbyl group having about 8 to about 22 carbon atoms; and X is an alkali metal, alkaline earth metal, or ammonium cation and n is the valence of cation X;

(IV)

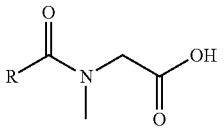

wherein R is a linear or branched, saturated, unsaturated, or partially saturated hydrocarbyl group having about 8 to about 22 carbon atoms; and (C) at least one compound of the formulae III and IV in combination with at least one compound of the formulae I and II;

wherein the engine oil composition is adapted for use as an engine oil, the engine oil composition has a phosphorus content of 50-1000 ppm and the engine oil composition comprises 0.1-2.0 wt. % of the one or more friction modifier components (A)-(C), based on the total weight of the engine oil composition.

2. The engine oil composition of claim 1, wherein the one or more friction modifier components are esters of the formula I.

3. The engine oil composition of claim 1, wherein the one or more friction modifier components are amides of the formula II.

4. The engine oil composition of claim 1, wherein the friction modifier component comprises at least one salt of the formula III.

5. The engine oil composition of claim 1, wherein the additive package comprises at least two different compounds independently selected from the group consisting of compounds of the formulae I-IV.

6. The engine oil composition of claim 1, wherein R has from about 10 to about 20 carbon atoms.

7. The engine oil composition of claim 1, wherein R has from about 12 to about 18 carbon atoms.

8. The engine oil composition of claim 2, wherein $R_1$ is hydrocarbyl group having from about 1 to about 8 carbon atoms.

9. The engine oil composition of claim 2, wherein $R_1$ is a hydrocarbyl group containing a $C_1$-$C_8$ hydrocarbyl group containing one or more heteroatoms.

10. The engine oil composition of claim 3, wherein $R_2$ and $R_3$ are independently selected from the group consisting of hydrogen, $C_1$-$C_{18}$ hydrocarbyl groups, and $C_1$-$C_{18}$ hydrocarbyl groups containing one or more heteroatoms.

11. The engine oil composition of claim 4, wherein the one or more friction modifier components of the formula III are salts of one or more cations selected from the group consisting of sodium, lithium, potassium, calcium, magnesium, and ammonium cations.

12. The engine oil composition of claim 1, wherein the additive package further comprises at least one additive selected from the group consisting of antioxidants, antifoam agents, molybdenum-containing compounds, titanium-containing compounds, phosphorus-containing compounds, viscosity index improvers, pour point depressants, and diluent oils.

13. An engine oil composition comprising a major amount of base oil and a minor amount of an additive package, wherein the additive package comprises one or more amide reaction products of:

one or more compounds of the formula IV:

(IV)

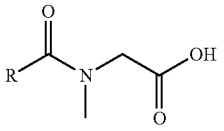

wherein R is a linear or branched, saturated, unsaturated, or partially saturated hydrocarbyl group having about 8 to about 22 carbon atoms, and one or more amines of the formula V:

(V)

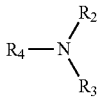

wherein $R_2$, $R_3$, and $R_4$ are independently selected from the group consisting of hydrogen, $C_1$-$C_{18}$ hydrocarbyl groups, and hydrocarbons containing $C_1$-$C_{18}$ hydrocarbyl groups and one or more heteroatoms, wherein the engine oil composition is adapted for use as an engine oil, the engine oil composition has a phosphorus content of 50-1000 ppm, and the engine oil composition comprises 0.1-2.0 wt. % of the amide reaction products, based on the total weight of the engine oil composition.

14. The engine oil composition of claim 13, wherein R has from about 10 to about 20 carbon atoms.

15. The engine oil composition of claim 13, wherein $R_2$, $R_3$, and $R_4$ are independently selected from the group consisting of hydrogen, $C_3$-$C_{12}$ hydrocarbyl groups, and hydrocarbons containing $C_3$-$C_{12}$ hydrocarbyl groups and one or more heteroatoms.

16. An engine oil composition comprising a major amount of a base oil having at least 90% saturates and being selected from a Group II, Group III, Group IV and Group V base oil and mixtures thereof, and a minor amount of an additive package, wherein the additive package comprises one or more a reaction products of one or more alcohols with one or more compounds of the Formula IV:

(IV)

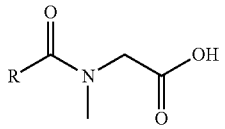

wherein R is a linear or branched, saturated, unsaturated, or partially saturated hydrocarbyl group having about 8 to about 22 carbon atoms wherein the engine oil composition is adapted for use as an engine oil, the engine oil composition has a phosphorus content of 50-1000 ppm, and the engine oil composition comprises 0.1-2.0 wt. % of the one or more alcohols with the one or more compounds of the formula IV, based on the total weight of the engine oil composition.

17. The engine oil composition of claim 16, wherein R is a hydrocarbyl group having from about 10 to about 20 carbon atoms.

18. The engine oil composition of claim 16, wherein the one or more alcohols contain a hydrocarbyl group having from about 1 to about 8 carbon atoms.

19. The engine oil composition of claim 16, wherein the one or more alcohols contain a hydrocarbyl group having from about 1 to about 8 carbon atoms and one or more heteroatoms.

20. An engine oil composition comprising a major amount of a base oil having at least 90% saturates and being selected from the group consisting of a Group II, Group III, Group IV and Group V base oil and mixtures thereof, and a minor amount of an additive package, wherein the additive package comprises one or more salt reaction products of:

one or more compounds of the formula IV:

(IV)

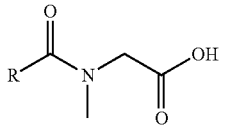

wherein R is a linear or branched, saturated, unsaturated, or partially saturated hydrocarbyl group having about 8 to about 22 carbon atoms, and one or more of an alkali metal hydroxide, and alkaline earth metal hydroxide, an alkali metal oxide, an alkaline earth metal hydroxide, ammonia, or an amine wherein the engine oil composition is adapted for use as an engine oil, the engine oil composition has a phosphorus content of 50-1000 ppm, and the engine oil composition comprises 0.1-2.0 wt. % of the one or more salt reaction products, based on the total weight of the engine oil composition.

21. A engine oil composition comprising a major amount of a base oil having at least 90% saturates and being selected from the group consisting of a Group II, Group III, Group IV and Group V base oil and mixtures thereof, and a minor amount of an additive package, wherein the additive package comprises one or more amide or ester reaction products of:

one or more compounds of the formula IV:

(IV)

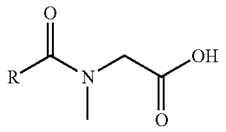

wherein R is a linear or branched, saturated, unsaturated, or partially saturated hydrocarbyl group having about 8 to about 22 carbon atoms, and one or more amine alcohol(s)

wherein the engine oil composition is adapted for use as an engine oil, the engine oil composition has a phosphorus content of 50-1000 ppm, and the engine oil composition comprises 0.1-2.0 wt. % of the one or more amide or ester reaction products, based on the total weight of the engine oil composition.

22. The engine oil composition as claimed in claim 21, wherein said amine alcohols are selected from the group consisting of ethanolamine, diethanolamine, aminoethyl ethanolamine, tris-hydroxymethyl amino-methane (THAM), and mixtures thereof.

23. An engine oil composition comprising a major amount of a base oil having at least 90% saturates and being selected from the group consisting of a Group II, Group III, Group IV and Group V base oil and mixtures thereof, and a minor amount of an additive package, wherein the additive package comprises (A) a salt reaction product of one or more compounds of the formula IV:

(IV)

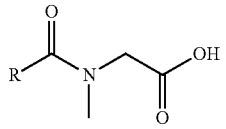

wherein R is a linear or branched, saturated, unsaturated, or partially saturated hydrocarbyl group having about 8 to about 22 carbon atoms, and one or more of an alkali metal hydroxide, and alkaline earth metal hydroxide, an alkali metal oxide, an alkaline earth metal hydroxide, ammonia, or an amine; and (B) at least one compound of the formulae I-IV different from the one or more compounds of component (A):

(I)

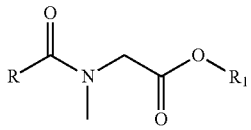

wherein R is a linear or branched, saturated, unsaturated, or partially saturated hydrocarbyl group having about 8 to about 22 carbon atoms and $R_1$ is a hydrocarbyl having from about 1 to about 8 carbon atoms or a $C_1$-$C_8$ hydrocarbyl group containing one or more heteroatoms;

(II)

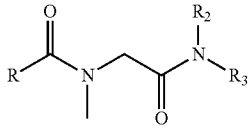

wherein R is a linear or branched, saturated, unsaturated, or partially saturated hydrocarbyl group having about 8 to about 22 carbon atoms and $R_2$ and $R_3$ are independently selected from the group consisting of hydrogen, $C_1$-$C_{18}$ hydrocarbyl groups, and $C_1$-$C_{18}$ hydrocarbyl groups containing one or more heteroatoms;

(III)

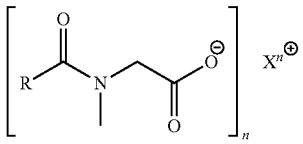

wherein R is a linear or branched, saturated, unsaturated, or partially saturated hydrocarbyl group having about 8 to about 22 carbon atoms; and X is an alkali metal, alkaline earth metal or ammonium cation and n is the valence of cation X; and (IV)

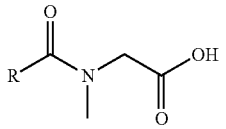

wherein R is a linear or branched, saturated, unsaturated, or partially saturated hydrocarbyl group having about 8 to about 22 carbon atoms wherein the engine oil composition is adapted for use as an engine oil, the engine oil composition has a phosphorus content of 50-1000 ppm, and the engine oil composition comprises 0.1-2.0 wt. % of a combination of the one or more reaction products (A) and the at least one compound (B), based on the total weight of the engine oil composition.

24. An engine oil composition comprising a major amount of a base oil having at least 90% saturates and being selected from the group consisting of a Group II, Group III, Group IV and Group V base oil and mixtures thereof, and a minor amount of an additive package, wherein the additive package comprises (A) one or more compounds of the formula IV:

(IV)

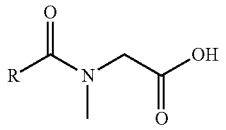

wherein R is a linear or branched, saturated, unsaturated, or partially saturated hydrocarbyl group having about 8 to about 22 carbon atoms; and (B) at least one compound of the formulae I-IV different from the one or more compounds of component (A):

(I)

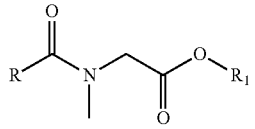

wherein R is a linear or branched, saturated, unsaturated, or partially saturated hydrocarbyl group having about 8 to about 22 carbon atoms and $R_1$ is a hydrocarbyl having from about 1 to about 8 carbon atoms or a $C_1$-$C_8$ hydrocarbyl group containing one or more heteroatoms;

(II)

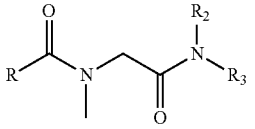

wherein R is a linear or branched, saturated, unsaturated, or partially saturated hydrocarbyl group having about 8 to about 22 carbon atoms and $R_2$ and $R_3$ are independently selected from the group consisting of hydrogen, $C_1$-$C_{18}$ hydrocarbyl groups, and $C_1$-$C_{18}$ hydrocarbyl groups containing one or more heteroatoms;

(III)

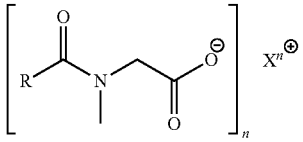

wherein R is a linear or branched, saturated, unsaturated, or partially saturated hydrocarbyl group having about 8 to about 22 carbon atoms; and X is an alkali metal, alkaline earth metal or ammonium cation and n is the valence of cation X; and (IV)

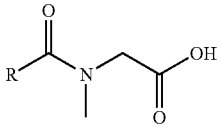

wherein R is a linear or branched, saturated, unsaturated, or partially saturated hydrocarbyl group having about 8 to about 22 carbon atoms wherein the engine oil composition is adapted for use as an engine oil, the engine oil composition has a phosphorus content of 50-1000 ppm, and the engine oil composition comprises 0.1-2.0 wt. % of a combination of the one or compounds (A) and the at least one compound (B) that is different from the one or more compounds (A), based on the total weight of the engine oil composition.

25. A method for improving thin film and boundary layer friction in an engine comprising the step of lubricating the engine with the engine oil composition as claimed in claim 1.

26. The method as claimed in claim 25, wherein the improved thin film and boundary layer friction is determined relative to a same composition in the absence of the one or more friction modifier components.

27. A method for improving boundary layer friction in an engine, comprising the step of lubricating the engine with the engine oil composition as claimed in claim 1.

28. The method as claimed in claim 27, wherein the improved boundary layer friction is determined relative to a same composition in the absence of the one or more friction modifier components.

29. A method for improving thin film friction in an engine, comprising the step of lubricating the engine with the engine oil composition as claimed in claim 1.

30. The method as claimed in claim 29, wherein the improved thin film friction is determined relative to a same composition in the absence of the one or more friction modifier components.

31. The engine oil composition of claim 1, wherein the base oil is at least one selected from the group consisting of a mineral oil, animal oil, and synthetic oil.

32. The engine oil composition of claim 16, wherein the base oil is at least one selected from the group consisting of a mineral oil, animal oil, and synthetic oil.

33. The engine oil composition of claim 20, wherein the base oil is at least one selected from the group consisting of a mineral oil, animal oil, and synthetic oil.

34. The engine oil composition of claim 23, wherein the base oil is at least one selected from the group consisting of a mineral oil, animal oil, and synthetic oil.

35. The engine oil composition of claim 24, wherein the base oil is at least one selected from the group consisting of a mineral oil, animal oil, and synthetic oil.

* * * * *

UNITED STATES PATENT AND TRADEMARK OFFICE

CERTIFICATE OF CORRECTION

PATENT NO. : 9,279,094 B2
APPLICATION NO. : 13/725216
DATED : March 8, 2016
INVENTOR(S) : Jeremy P. Styer and John T. Loper It is certified that error appears in the above-identified patent and that said Letters Patent is hereby corrected as shown below:

In the Claims

Claim 20, in line 15 of Column 39, replace the word "and" with "an".

Claim 20, in lines 16-17 of Column 39, replace the phrase "alkali metal oxide, an alkaline earth metal hydroxide" with "alkali metal or alkaline earth metal oxide".

Claim 23, in line 17 of Column 40, replace the word "and" with "an".

Claim 23, in lines 18-19 of Column 40, replace the phrase "alkali metal oxide, an alkaline earth metal hydroxide" with "alkali metal or alkaline earth metal oxide".

Signed and Sealed this
Twenty-eighth Day of June, 2016

Michelle K. Lee

Michelle K. Lee
*Director of the United States Patent and Trademark Office*